US007179150B2

(12) United States Patent
Luk et al.

(10) Patent No.: US 7,179,150 B2
(45) Date of Patent: Feb. 20, 2007

(54) BRASSIERE

(75) Inventors: Theone Luk, Kwai Chung (HK); Zhen Qiang Liu, Kwai Chung (HK)

(73) Assignee: Regina Miracle International Limited, Hong Kong (HK)

( * ) Notice: Subject to any disclaimer, the term of this patent is extended or adjusted under 35 U.S.C. 154(b) by 0 days.

(21) Appl. No.: 10/864,255

(22) Filed: Jun. 8, 2004

(65) Prior Publication Data

US 2004/0224604 A1 Nov. 11, 2004

Related U.S. Application Data

(63) Continuation-in-part of application No. 10/349,514, filed on Jan. 21, 2003, now Pat. No. 6,805,610.

(51) Int. Cl.
*A41C 3/00* (2006.01)
*A41C 3/14* (2006.01)

(52) U.S. Cl. ..... 450/39; 450/57

(58) Field of Classification Search ..... 450/54–57, 450/39, 90, 92, 93, 41, 45–53; 264/257, 264/258, 291, 292, 294, 320, 321, 145, 148, 264/153–155, 157, 160, 163; 156/245
See application file for complete search history.

(56) References Cited

U.S. PATENT DOCUMENTS 3,114,374 A * 12/1963 Chalfin et al. ..... 450/41
4,080,416 A * 3/1978 Howard ..... 264/258
4,235,240 A * 11/1980 Cousins ..... 450/52
4,244,249 A * 1/1981 DiTullio ..... 83/139
4,250,137 A * 2/1981 Riedler ..... 264/554
5,769,688 A * 6/1998 Holliday ..... 450/57
5,820,443 A * 10/1998 Burr ..... 450/40
5,967,877 A * 10/1999 Howard ..... 450/57
6,213,841 B1 * 4/2001 Kuo ..... 450/55
6,257,951 B1 * 7/2001 DeMarco ..... 450/55
6,645,040 B2 * 11/2003 Rabinowicz et al. ..... 450/1
2002/0106970 A1 8/2002 Falla ..... 450/1
2005/0020183 A1 1/2005 Falla ..... 450/39
2005/0208874 A1 9/2005 Lau ..... 450/39

FOREIGN PATENT DOCUMENTS

| | | |
|---|---|---|
| FR | 2 820 001 | 8/2002 |
| JP | 2000226704 | 8/2000 |
| TW | 560252 | 9/2002 |
| WO | WO 02/054894 A1 | 7/2002 |
| WO | WO 2004/073433 | 9/2004 |

* cited by examiner

*Primary Examiner*—Gloria Hale
(74) *Attorney, Agent, or Firm*—Ostrolenk, Faber, Gerb & Soffen, LLP

(57) ABSTRACT

A moulded brassiere having a core of a first molded foam and a laminated second foam layer. An intermediate bridge between the cups with a flexible non-stretch bridge between the cups. Outer fabric layers extend beyond the core and defining straps.

29 Claims, 4 Drawing Sheets

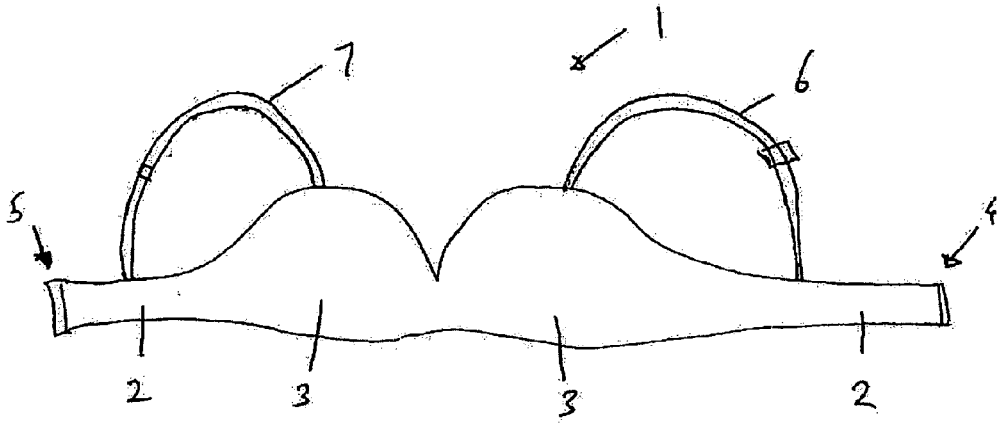
Fig 1
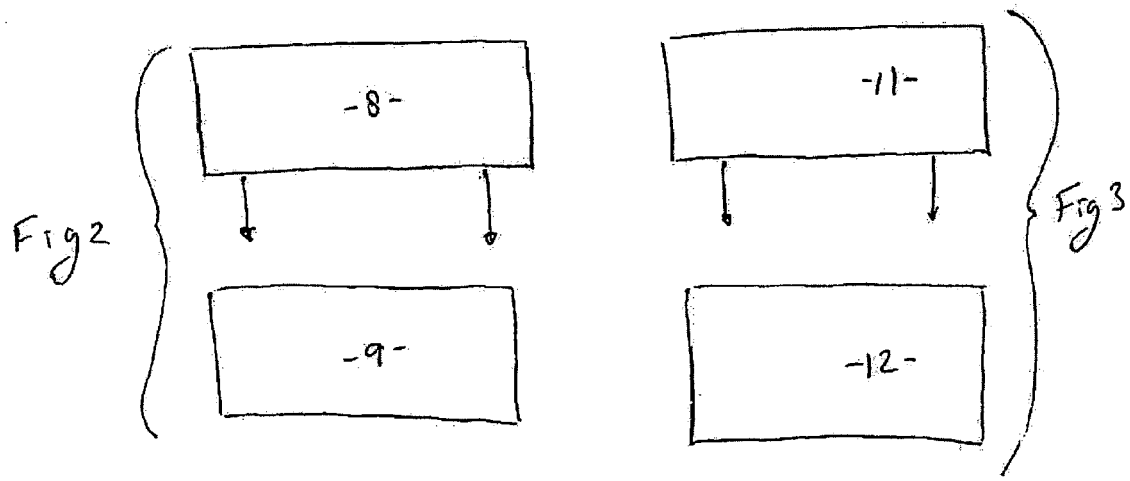
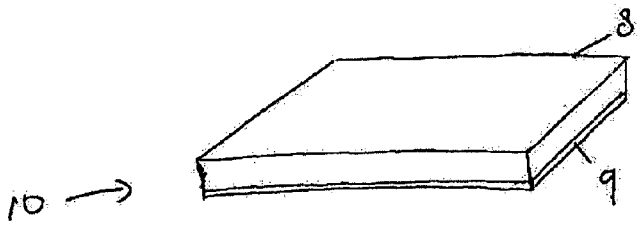
Fig 4
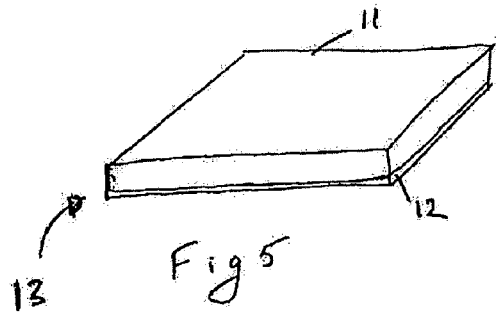
Fig 5

BRASSIERE

PRIORITY CLAIM

This is a continuation-in-part of U.S. Pat. application Ser. No. 10/349,514, filed Jan. 21, 2003 now U.S. Pat. 6,805,610.

FIELD OF THE INVENTION

The present invention relates to brassieres and in particular to a brassiere which incorporates a seamless breast cup construction and wherein the entire brassiere includes a negligible amount of stitching joining various components of the brassiere together.

BACKGROUND TO THE INVENTION

Construction details of brassieres (hereinafter referred to as "bras") have been developed over many years. Construction details have evolved along with the introduction of new materials and new processes which can be utilized for the manufacturing of bras. As with most consumer products, manufacturers endeavor to reduce the cost of goods sold. A reduction in cost of goods sold can be brought about by the use of cheaper materials. For bra technology however, a significant saving in the cost of a bra can be achieved by eliminating the man-hours required to manufacture the bra. Many bras that are available on the market will include multiple panels of materials which need to be cut, and joined. Cutting can be automated, however when it comes to stitching the panels together, this will mostly be done by a person. The breast cup of a bra may consist of multiple panels which each need to be stitched together, the entire breast cup then needs to be stitched to the chest band and to the over the shoulder straps. Perimeter stitching or overlooking to ensure that the edges of the material of the bra do not fray also needs to be added to the bra. Such is also done by a person. It can hence be seen that in order to manufacture a bra, the labor component of the overall cost can be relatively high.

Accordingly it is an object of the present invention to provide a bra which reduces the amount of stitching that is required compared to the majority of bras available on the market. It is also an object of the present invention to provide a seamless breast cup construction which will at least provide the public with a useful choice.

It is also an object of the present invention to provide a method of manufacturing a seamless breast cup construction and related bra incorporating such construction to reduce the labor content of manufacturing of the bra or to at least provide the public with a useful choice.

BRIEF DESCRIPTION OF THE INVENTION

In a first aspect the present invention consists in a moulded brassiere including, a core assembly of at least a first layer of moulded foam material and a second layer of foam material laminated with said first layer said core assembly defining two breast cup regions and an intermediate bridge region extending there between and wherein a layer of flexible material having non-stretch properties is provided intermediate of and laminated to said first and second layer of moulded foam material at said bridge region, said flexible material having non-stretch properties oriented so that across the bridge region parallel to the cup to cup direction said core assembly is non-stretchable, and a first and second exterior layer each of at least a fabric material layer disposed outward most and each laminated with said core assembly on a respective side of said core assembly to encase said core assembly, said first and second exterior layers extending beyond the perimeter of said core assembly to provide at least that part of the brassiere defining chest strap(s).

Preferably said first layer and said second layer of foam are laminated directly to each other save for said flexible material having non-stretch properties.

Preferably said flexible material having non stretch properties is provided extending at said bridge region only.

Preferably said flexible material having non stretch properties is captured intermediate of said first and second layer of moulded foam material.

Preferably said flexible material having non stretch properties is a woven fabric material.

Preferably said flexible material having non stretch properties is a woven fabric material with bi directional non-stretch properties and is oriented such that the non stretch orientation extends across said bridge region parallel to the cup to cup direction of said core assembly.

Preferably said first and second layers of foam are coextensive with each other.

Preferably said core assembly is of a shape defining only the breast cups and said bridge but not said chest strap(s).

Preferably said chest straps extending outwardly from each side of said core assembly provided region of said moulded brassiere.

Preferably said first and second layers of foam are co extensive.

Preferably said first and second layers of foam are laminated directly to each other save for where said flexible material having non stretch properties is provided said breast cup regions having been moulded therein simultaneous to the lamination of said core assembly.

Preferably two underwire structures are provided intermediate of said first sheet and said second layers, one each adjacent the breast cup regions.

Preferably said underwire structure comprises a rigid elongate member and a flexible material casing about at least part of said rigid elongate member.

Preferably said casing is a fabric material.

Preferably said casing is adhered to one or each of the facing surfaces of said first and second layers of foam by an adhesive material.

Preferably said casing is a tubular sock within which said rigid elongate member is located, the sock having closed distal ends.

Preferably said first exterior layer is an assembly of laminated plies of a fabric material ply provided outwardly of said assembly and a foam ply provided inward of said fabric material ply.

Preferably said foam layer ply of said exterior layer is laminated to said core assembly.

Preferably said fabric material ply and said foam ply of said exterior layer are coextensive.

Preferably said second exterior layer is an assembly of laminated plies of a fabric material ply provided outwardly of said assembly and a foam ply provided inward of said fabric material ply.

Preferably foam layer ply of said second exterior layer is laminated to said core assembly.

Preferably said fabric material ply and said foam ply of said exterior layer are coextensive.

In a second aspect the present invention consists in a method of manufacturing a moulded component assembly for a brassiere comprising:

placing a core assembly of a first layer of foam material and a second layer of foam material between which there is sandwiched a layer of flexible material having non stretch properties intermediate of two mold portions of a molding machine each portion defining a complementary shaped two cup defining molding surface, and wherein said layer of flexible fabric material is located at a region intermediate of said two cup molding said core assembly by bringing said mold portions towards each other wherein the bringing together thereby subjects said core assembly to a molding force which with the combination of heat, will permanently impress two cup forms, trimming said core assembly to define a moulded core assembly perimeter form which includes said two cups forms and a bridge region extending there between sandwiching said moulded core assembly between two exterior layers of flexible material including an outer layer of a fabric material trimming said two exterior layers to define a perimeter which includes about the chest securing straps.

Preferably said molding of said second layer of foam material to said first layer of foam material is achieved by the placement of said second layer adjacent said first layer and applying a force pressing said second sheet and said first layer together and with the application of heat and an appropriate dwell time of pressing thereby adhering said first and second layer together.

Preferably prior to molding of said first and second layer of foam, an underwire structure is provided intermediate of said first and second layer.

In a further aspect the present invention consists in a method of making a brassiere comprising taking a core assembly of at least a first layer of moulded foam material and a second layer of foam material laminated with said first layer said core assembly defining two breast cup regions and an intermediate bridge region extending there between and wherein a layer of flexible material having non-stretch properties is provided intermediate of and laminated to said first and second layer of moulded foam material at said bridge region, said flexible material having non-stretch properties oriented so that across the bridge region and parallel to the cup to cup direction said core assembly is non-stretchable and sandwiching the core assembly between a first and second exterior layer each comprising of at least a fabric material layer disposed outward most and each laminated with said core assembly on a respective side of said core assembly to encase said core assembly, said first and second exterior layers extending beyond the perimeter of said core assembly and perimeter trimming such to provide also, the brassiere chest strap(s).

Preferably each of said two exterior layer are affixed to opposite sides of said core assembly by adhesive molding.

Preferably each of said two exterior layer are affixed to opposite sides of said core assembly by an adhesive.

Preferably adhesion of said shoulder straps and said back clasp to said chest straps is achieved by ultrasonic welding.

BRIEF DESCRIPTION OF THE DRAWINGS

A preferred embodiment of the present invention will now be described with reference to the accompanying figures.

FIG. 1 is a front view of a brassiere (hereinafter referred to as a "bra") made in accordance to the methods of the invention hereinafter described, FIG. 2 is a plan view of two layers of precursor material, the upper being a foam material and the lower being a fabric material to be laminated together, FIG. 3 is a plan view of precursor layers of material, the upper being a foam material and the lower being a fabric material, FIG. 4 illustrates the layers of FIG. 2 having been laminated together to define a precursor outer assembly by the use of, for example, an adhesive and/or heat lamination, FIG. 5 is a perspective view of the layers of FIG. 3 having been laminated together to define a precursor outer assembly wherein the lamination has been achieved by an adhesive and/or heat lamination.

DETAILED DESCRIPTION OF THE INVENTION

Figure 6:
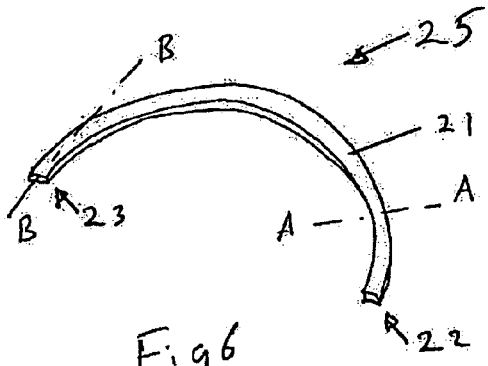
FIG. 6 is a perspective view of an underwire assembly to be incorporated in the bra of the present invention.

With reference to FIG. 1 there is shown a front view of a bra which has been manufactured according to the method as herein described.

The bra 1 consists of an assembly of panels which have been laminated together to define a single structure incorporating the chest band 2 and two breast cup forms 3. The chest band 2 may at their free ends 4, 5 be provided with mutually interactable catches or locking elements to allow for the free ends 4 and 5 to be engaged together. Also provided may be shoulder straps 6, 7 which are fixed to an appropriate region of the unitary chest strap and cup assembly of panels to allow for such to have over the shoulder support from the wearer of a bra.

Such over the shoulder straps may however be optional as it is envisaged that the bra may be of a strapless version. Indeed whilst reference is herein made to the most preferred form of the present invention acting as a bra, it is envisaged that the assembly of panels to define such may alternatively be incorporated into other garments such as, for example, evening dresses or bathing suits or similar.

Reference will now be made to a preferred method of construction which will explain the particular assembly of panels which may be provided to create the bra of FIG. 1.

With reference to FIG. 2 there is shown two precursor layers, panels or sheets, or plies of material (hereinafter "layer"), the first layer 8 being of a foam material, preferably of a thickness of 3.1 mm.

The second layer 9 is a fabric material such as the product known by model number CMF-7440MU of Friendly Foundate Ltd. This is a fabric and is made of 80% Tactel and 20% lycra.

The foam is preferably a polyurethane foam of a density of, for example, 30–40d.

Figure 15:
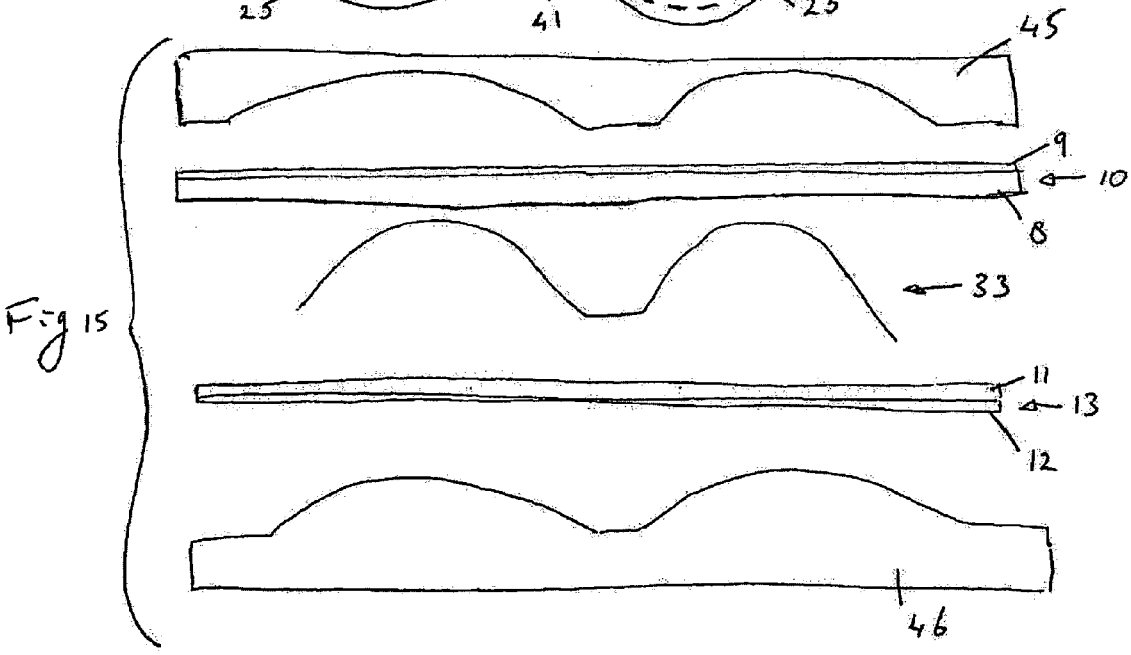
FIG. 15 is a sectional view through a molding device providing upper and lower mold portions intermediate of which the flexible core assembly of FIG. 14 is placed and relative to which the core precursor panel assembly of FIGS. 4 and 5 are positioned for the subsequent mold forming and lamination of the plies together.

The fabric layer 9 may have a make-up of approximately 80% Tactel 40d/34f and 20% lycra 40d and of a weight of, for example, 190g/m$^2$. With reference to FIG. 4, the foam panel 8 and the fabric panel 9 to provide an exterior assembly of panels, have been laminated together. The first exterior panel assembly 10 comprises of the layer of foam 8 laminated to the layer of fabric 9. The layers are preferably substantially co-extensive with each other and have been laminated together using an adhesive such as glue HM-1 of Forbo Swift Adhesives SA. This glue will stick the fabric and foam together when dry without heating. It is sprayed onto at least one of the facing surfaces of the foam or fabric panels 8, 9. The surface of foam panel 8 that is not facing fabric panel 9 is also sprayed with a glue such as RM-30 of Ultra Energy Adhesive Trading Co., Ltd. This glue will dry without sticking but will stick when heated in the mold during the molding process shown in FIG. 15 and described hereinbelow.

With reference to FIG. 3 there are shown a foam panel 11 and a fabric panel 12 which similar to the foam panel 8 and fabric panel 9 are laminated together to define a second exterior panel assembly 13 as shown in FIG. 5. The foam panel 11 is of a foam such as EWA35 of Inoac Corporation which is a polyurethane and is of a thickness of 1.7 mm.

The fabric panel 12 is preferably the same as that of the fabric panel 9. The second exterior panel assembly 13 is to be provided (once fully manufactured) to the interior side of the bra and the first exterior assembly 10 is to be provided to the exterior side of the bra. The fabric panels 9, 12 will be provided as the exterior most panels to the bra. Again, the surface of foam panel 11 that is not facing fabric panel 12 is also sprayed with a glue such as RM-30 of Ultra Energy Adhesive Trading Co., Ltd.

Figure 7:
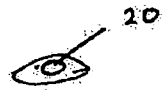
FIG. 7 is a sectional view through Section AA of FIG. 6.
Figure 8:
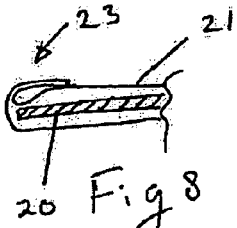
FIG. 8 is a sectional view through Section BB of FIG. 6.

As part of the bra of the present invention an underwire may be provided incorporated with the bra. The underwire structure consists of a substantially rigid but to a certain extent flexible wire 20 which may be of a diameter of, for example, 2 mm as shown in FIG. 7. The wire may be made from a material such as stainless steel. The wire is captured within a sock 21. The sock has been closed at each end 22, 23 as, for example, shown in FIG. 8. The sock may be made from a material such as TRICOT. The closure at the end of the sock 22, 23 may be achieved by using the ultrasonic machine to bond. The underwire assembly 25 is then ready for subsequent use. The bra however may not incorporate the underwire in its final form.

Figure 9:
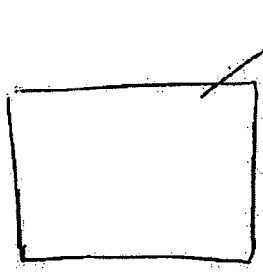
FIG. 9 is a plan view of a precursor layer of material of foam.

With reference to FIG. 9 there is shown a plan view of a layer of foam material 29 which is to form the convex side disposed layer of material for the core assembly layers for the bra. The foam layer 29 is preferably of a polyurethane foam/memory foam such as, for example, EL58-4S of Inoac Corporation which is a polyurethane/memory foam and is of a thickness of, for example, 6 mm.

Figure 10:
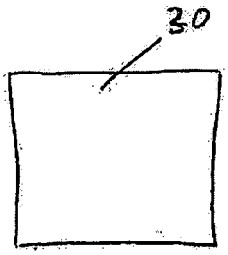
FIG. 10 is a plan view of a precursor layer of another foam material.
Figure 11:
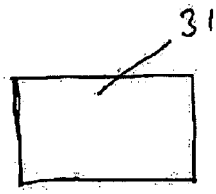
FIG. 11 is a plan view of a precursor fabric layer.
Figure 12:
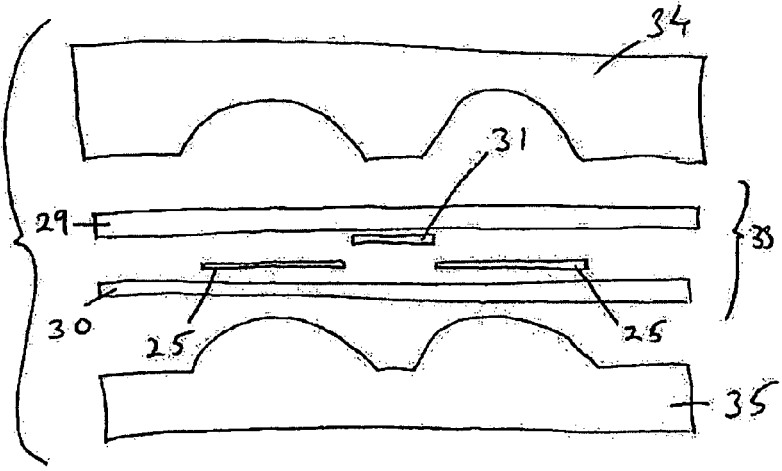
FIG. 12 is a sectional view through a molding device consisting of an upper and lower mold intermediate of which an assembly of core assemblies of the layers of FIG. 9, 10 and 11 and the underwire assembly are placed for the simultaneous molding and lamination thereof to define a moulded core assembly capturing within the assembly the underwire assemblies underneath or adjacent of each of the cups mold formed in the layers.

FIG. 10 is a plan view of a layer of foam 30 which is to form a layer to the concave side of a core assembly of layers to be used in the bra of the present invention. The foam layer 30 is made of a polyurethane foam/memory foam such as, for example, EL58-4S of Inoac Corporation. It is preferably also of a thickness of approximately 6 mm. In FIG. 11 there is shown a plan view of a layer of fabric material 31 which is to be incorporated as part of the core assembly of layers including layers 29 and 30.

The fabric layer 31 is of fabric 7118 of Goldspring Co. Ltd. It is preferably a piece of gauze which is 100% nylon. This layer is included in the assembly to define the core assembly of layers to be provided intermediate of the two foam panels 29 and 30 of the core assembly. The fabric material layer 31 is provided to be engaged intermediate of the foam layers 29 and 30 at a region which is to define the location intermediate of the two cup forms 39 and 40 to be moulded into the core assembly 33. The fabric layer 31 accordingly becomes located intermediate of the two cup forms. It provides resistance against the elasticity which may otherwise be resultant in the region intermediate of the cups were there only the foam layers 29 and 30 provided at such an intermediate region. It is important to ensure that the cups remain at a constant disposition relative to each other. Accordingly in order to reduce the elasticity of the core assembly at the region intermediate of the cups, such a fabric layer is provided. In the most preferred form such a centre fabric layer 31 does not extend to be provided in a region below the breast cups. It merely extends at the region which bridges between the breast cup forms to be moulded therein and preferably no further. However at such bridging region the foam panels are also still provided. Each of the to be laminated sides of the layers 31, 29 and 30 and also the sock 21 of the underwire assembly 25 are sprayed with an adhesive whereupon they are then assembled but yet remain in a planar form. Two underwire assemblies 25 if used, are positioned intermediate of the foam layers 29 and 30 at appropriate locations at where a cup form is to be moulded into the core assembly 33 comprising of the layers 29, 30, 31 and optionally any additional layers engaged exteriorly from or intermediate thereof. Molding of the assembly of layers 33 then occurs by the mold portions 34, 35. The mold portions 34, 35 have surface relief provided thereto for the purposes of molding and introducing into the core assembly 33 two cup forms. The upper mold 34 is preferably of a temperature of 180° C. to 200° C. and the lower mold is preferably of 180° C. to 200° C. The fabric material 31 is preferably applied with an adhesive to both sides. The dwell time holding the mold portions together is for example 120 seconds.

Figure 13:
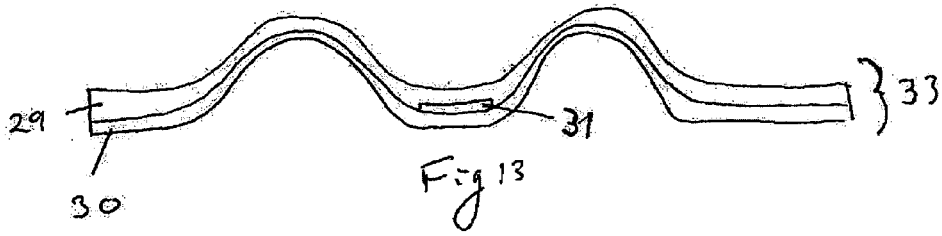
FIG. 13 is a sectional view through the two cup forms of the assembly of layers shown in FIG. 12 after the mold forming and lamination thereof.
Figure 14:
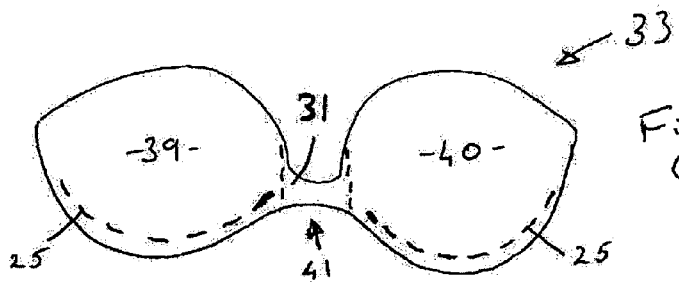
FIG. 14 is a plan view of the flexible core assembly of FIG. 13 and wherein perimeter trimming has occurred to define a core assembly of layers.

With reference to FIG. 13 there is shown a cross sectional view of the core assembly 33. FIG. 14 illustrates the core assembly 33 after having its perimeter trimmed to define a core cup assembly wherein two cup forms 39–40 are provided and remain interconnected through the transition region 41 to provide as a unit assembly, the core cup assembly 33. It can accordingly be seen that the core cup assembly 33 is of a unitary assembly of layers. All of the layers of the cup assembly, save for the fabric layer 31 are substantially coextensive with each other. Where an underwire assembly is provided underneath each cup form, it remains that the foam panels 29 and 30 remain substantially coextensive with each other.

The unit assembly 33 is then adhesively laminated with the exterior assembly of panels 10 and 13 again by a molding device consisting of two mold portions 45, 46 which each have surface relief features defining two cup forms. The panel assemblies 10 and 13 are of a size which are sufficiently large so that the assemblies 10 and 13 can also provide the straps 2 extending from the cup regions 3. The top mold in the molding process of the core assembly 33 with the exterior panel assemblies 10 and 13 is provided where the top mold is at a temperature of approximately 180° and the bottom mold is approximately 170°. The dwell time is for example 120 seconds. As well as heat being used to ensure a lamination between the core assembly 33 and the exterior panel 10 and 13 occurs, the core assembly may be sprayed with an adhesive such as glue RM-30 of Ultra Energy Adhesive Trading Co. on both faces of the core assembly.

Figure 16:
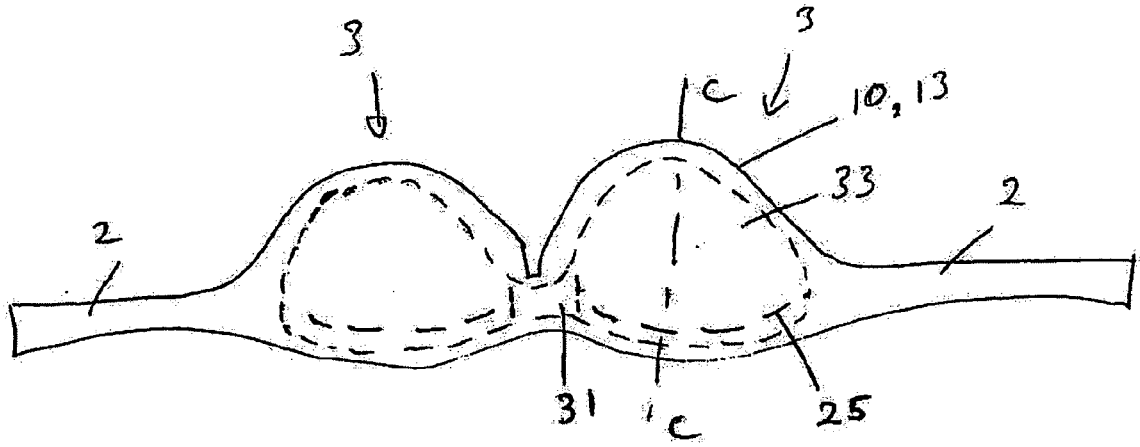
FIG. 16 is a plan view of the assembly of panels moulded according to the molding process of FIG. 15 and wherein excess perimeter material has been trimmed.

The assembled exterior panel assemblies 10 and 13 with the core assembly 33 moulded to the appropriate form can then be trimmed to assume a form as for example, shown in FIG. 16. Such trimming may occur manually or may be done ultrasonically by an ultrasonic machine such as device EGR-053 of Ever Green Ultrasonic Co., Ltd. and a trimming roller 28. The ultrasonic trimming device cuts and bonds the edge together at the same time.

As can be seen the core assembly 33 is of a perimeter which is smaller than the trimmed perimeter of the exterior panel assemblies 10, 13. Accordingly the core assembly 33 is captured within the exterior panel assemblies 10, 13.

Figure 17:
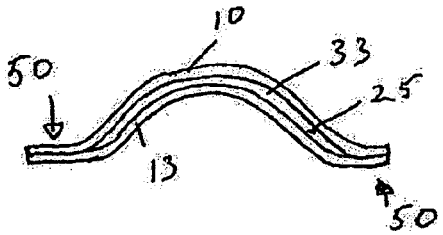
FIG. 17 is a sectional view through Section CC of FIG. 16.

FIG. 17 shows the perimeter region 50 of the bra through Section CC wherein the exterior panel assemblies 10 and 13 are engaged to each other at the perimeter and capture there within the core assembly 33.

Subsequent to the trimming, the peripheral components such as the catches 4, 5 and the over the shoulder straps may be fastened to the breast cup assembly as shown in FIG. 16. The shoulder straps may be length adjustable and the catches may allow for the adjustment of the size of the around the chest perimeter of the bra. Such peripheral components are preferably engaged to the assembly of FIG. 16 by the use of ultrasonic welding.

Whilst reference has herein been made to the provision of the exterior assemblies 10 and 13 consisting of a layer of foam 8, 11 and a layer of fabric 9, 12, it may well be that either or both of the exterior assemblies 10, 13 only provide the fabric layer 9, 12.

The construction of the present invention is simplified by the fact that the core assembly is a single piece assembly of layers. In this manner this invention does not require for the orientation of two independent cup forms in respect of the sandwiching or exterior layers of fabric and foam but merely requires the handling of the single core assembly for such purposes. The bra can also be manufactured substantially without or with no significant stitching.

The invention claimed is:

1. A molded brassiere including, a core assembly of at least a first layer of molded foam material and a second layer of foam material laminated with said first layer; said core assembly having a perimeter and defining two breast cup regions and an intermediate bridge region extending there between and wherein a layer of flexible material having non-stretch properties is provided intermediate of and laminated to said first and second layer of molded foam material at said bridge region, said flexible material having non-stretch properties oriented so that across the bridge region parallel to the cup to cup direction said core assembly is non-stretchable, and a first and second exterior layer, each exterior layer being of at least a fabric material layer disposed outward most and each exterior layer being laminated with said core assembly on a respective side of said core assembly to encase said core assembly, said first and second exterior layers extending beyond said perimeter of said core assembly to provide at least a part of the brassiere defining chest strap(s).

2. A molded brassiere as claimed in claim 1 wherein said first layer and said second layer of foam are laminated directly to each other except for said flexible material having non-stretch properties.

3. A molded brassiere as claimed in claim 1 wherein said flexible material having non stretch properties is provided extending at said bridge region only.

4. A molded brassiere as claimed in claim 1 wherein said flexible material having non stretch properties is captured intermediate of said first and second layer of molded foam material.

5. A molded brassiere as claimed in claim 1 wherein said flexible material having non stretch properties is a woven fabric material.

6. A molded brassiere as claimed in claim 1 wherein said flexible material having non stretch properties is a woven fabric material with bi-directional non-stretch properties and is oriented such that the non stretch orientation extends across said bridge region parallel to the cup to cup direction of said core assembly.

7. A molded brassiere as claimed in claim 1 wherein said first and second layers of foam are coextensive with each other.

8. A molded brassiere as claimed in claim 1 wherein said core assembly is of a shape defining only the breast cups and said bridge but not said chest strap(s).

9. A molded brassiere as claimed in claim 1 wherein said chest straps extending outwardly from each side of said core assembly provided region of said molded brassiere.

10. A molded brassiere as claimed in claim 1 wherein said first and second layers of foam are co extensive.

11. A molded brassiere as claimed in claim 1 wherein said first and second layers of foam are laminated directly to each other except for where said flexible material having non stretch properties is provided said breast cup regions having been molded therein simultaneous to the lamination of said core assembly.

12. A molded brassiere as claimed in claim 1 wherein two underwire structures are provided intermediate of said first sheet and said second layers, and each of the underwire structures is adjacent a respective one of the breast cup regions.

13. A molded brassiere as claimed in claim 12 wherein said underwire structure comprises a rigid elongate member and a flexible material casing about at least part of said rigid elongate member.

14. A molded brassiere as claimed in claim 13 wherein said casing is a fabric material.

15. A molded brassiere as claimed in claim 13 wherein said first and second layers of foam have mutually facing surfaces, and said casing is adhered to one or each of said facing surfaces of said first and second layers of foam by an adhesive material.

16. A molded brassiere as claimed in claim 13 wherein said casing is a tubular sock within which said rigid elongate member is located, said sock having closed distal ends.

17. A molded brassiere as claimed in claim 1 wherein said first exterior layer is an assembly of laminated plies of a fabric material ply provided outward of said assembly and a foam ply provided inward of said fabric material ply.

18. A molded brassiere as claimed in claim 17 wherein said foam layer ply of said exterior layer is laminated to said core assembly.

19. A molded brassiere as claimed in claim 17 wherein said fabric material ply and said foam ply of said exterior layer are coextensive.

20. A molded brassiere as claimed in claim 1 wherein said second exterior layer is an assembly of laminated plies of a fabric material ply provided outward of said assembly and a foam ply provided inward of said fabric material ply.

21. A molded brassiere as claimed in claim 20 wherein said foam layer ply of said second exterior layer is laminated to said core assembly.

22. A molded brassiere as claimed in claim 20 wherein said fabric material ply and said foam ply of said exterior layer are coextensive.

23. A method of manufacturing a molded component assembly for a brassiere comprising:

placing a core assembly of a first layer of foam material and a second layer of foam material between which there is sandwiched a layer of flexible material having non stretch properties intermediate of two mold portions of a molding machine each portion defining a complementary shaped two cup defining molding surface, and wherein said layer of flexible fabric material is located at a region intermediate of said two cups, molding said core assembly by bringing said mold portions towards each other wherein the bringing together thereby subjects said core assembly to a molding force which with the combination of heat, will permanently impress two cup forms, trimming said core assembly to define a molded core assembly perimeter form which includes said two cups forms and a bridge region extending there between sandwiching said molded core assembly between two exterior layers of flexible material including an outer layer of a fabric material trimming said two exterior layers to define a perimeter which includes about the chest securing straps.

24. A method as claimed in claim 23 wherein said molding of said second layer of foam material to said first layer of foam material is achieved by the placement of said second layer adjacent said first layer and applying a force pressing said second sheet and said first layer together and with the application of heat and an appropriate dwell time of pressing thereby adhering said first and second layer together.

25. A method as claimed in claim 23 wherein prior to molding of said first and second layer of foam, an underwire structure intermediate of said first and second layer.

26. A method of making a brassiere comprising providing a core assembly of at least a first layer of molded foam material and a second layer of foam material laminated with said first layer of said core assembly defining two breast cup regions and an intermediate bridge region extending there between and wherein a layer of flexible material having non-stretch properties is provided intermediate of and laminated to said first and second layer of molded foam material at said bridge region, said flexible material having non-stretch properties oriented so that across the bridge region parallel to the cup to cup direction said core assembly is non-stretchable and sandwiching the core assembly between a first and second exterior layer, each exterior layer comprising at least a fabric material layer disposed outward most and each laminated with said core assembly on a respective side of said core assembly to encase said core assembly, said first and second exterior layers extending beyond the perimeter of said core assembly and perimeter trimming said exterior layers to provide brassiere chest strap(s).

27. A method as claimed in claim 26 wherein each one of said two exterior layers is affixed to opposite sides of said core assembly by adhesive molding.

28. A method as claimed in claim 26 wherein each one of said two exterior layers is affixed to opposite sides of said core assembly by an adhesive.

29. A method as claimed in claim 28 further comprising adhering shoulder straps and a back clasp to said chest straps by ultrasonic welding.

* * * * *